United States Patent [19]

Samuelsson

[11] Patent Number: 4,679,370

[45] Date of Patent: Jul. 14, 1987

[54] SURFACE-FORMING PANEL

[76] Inventor: Björn Samuelsson, 93, Ryttmästarvägen, Vällingby, Sweden, S-162 24

[21] Appl. No.: 852,087

[22] Filed: Apr. 14, 1986

Related U.S. Application Data

[63] Continuation of Ser. No. 548,159, Nov. 2, 1983, abandoned.

[30] Foreign Application Priority Data

Nov. 5, 1982 [SE] Sweden ..... 8206293

[51] Int. Cl.[4] ..... E04B 2/00

[52] U.S. Cl. ..... 52/407; 52/484; 52/799; 52/807

[58] Field of Search ..... 52/406, 407, 484, 486, 52/799, 807, 817, 404, 238.1

[56] References Cited

U.S. PATENT DOCUMENTS

| | | | |
|---|---|---|---|
| 2,061,486 | 11/1936 | Schuh . | |
| 3,165,791 | 1/1965 | Valsvik | 52/407 |
| 3,166,800 | 1/1965 | Zoldok | 52/799 X |
| 3,174,191 | 3/1965 | Valsvik | 52/407 |
| 3,413,765 | 12/1968 | Williams et al. | 52/809 X |
| 4,315,962 | 2/1982 | Skoien | 52/406 X |

FOREIGN PATENT DOCUMENTS

| | | |
|---|---|---|
| 650499 | 9/1937 | Fed. Rep. of Germany . |
| 62696 | 7/1940 | Norway . |
| 402611 | 7/1978 | Sweden . |
| 757418 | 9/1956 | United Kingdom . |

*Primary Examiner*—William F. Pate, III
*Assistant Examiner*—R. Chilcot
*Attorney, Agent, or Firm*—Holman & Stern

[57] ABSTRACT

Surface-forming panel, especially intended for intermediate walls, ceilings, floors and external walls and the like, consisting of a framework of sheet metal profiles or the like supporting a sheet material which preferably has a finish or facing ready for use.

The new feature is that profiles (3, 4) constituting the framework are fixed to the panel (1) already before this is mounted, and that these profiles are adapted, to minimize the total panel thickness, to be carried to its operative position projecting from the back of the panel, only after having arrived on the mounting site, and that the profiles (3, 4), which are attached to the panel (1), are adapted to be mounted in folded position closely applied to the panel and are provided with bending notches (17) to facilite unfolding thereof.

12 Claims, 21 Drawing Figures

SURFACE-FORMING PANEL

This is a continuation of application Ser. No. 548,159, filed Nov. 2, 1983, now abandoned.

The present invention relates to a surface-forming panel intended for walls such as intermediate and external walls, ceilings and roofs, floors and the like, consisting of a framework of sheet metal profiles or the like and sheet material preferably provided with finish or facing ready for use.

Light, often sound-insulating walls and other room separating units of relatively thin sheet material, such as gypsum, chips and fibre board with a supporting framework of steel studs are of frequent use today. For assembling such walls or separating units a stud structure is first built up on which the sheet material is then mounted. The object of this invention is to provide a surface-forming panel, primarily regarded as staple goods, which is of such construction that the buildup of the supporting framework as a separate working moment is eliminated. Building components for specific purposes have earlier been used having panels mounted on either side of e.g. wooden studs but these components have not become very popular because they have been confined to certain sizes and been unwieldy and especially because of the problems entailed with transport and handling, since finished components with studs require a transport volume which is many times greater than that required for panels alone, and another object of this invention is to overcome this inconvenience.

The new feature of the panel according to the invention which, as distinguished from prior art components is to be regarded as a building panel with an integrated framework, is that profiles constituting a framework are fixed in the panel already before this is mounted, and that these profiles are adapted to be carried into its operative position projecting from the back of the panel, only after having arrived on the mounting site.

Examples of embodiments of panels according to the invention, examples of mounting, and tools for getting panels ready for mounting will be described in more detail below with reference to the accompanying drawings, in which.

Figure 20:
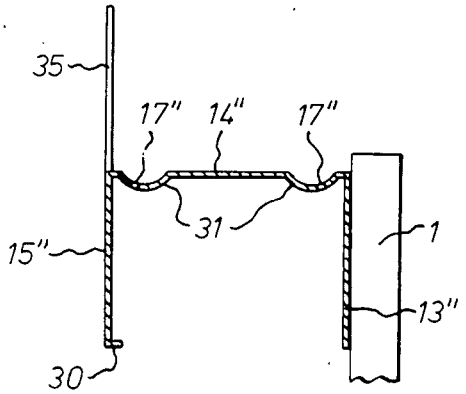
Figure 19:
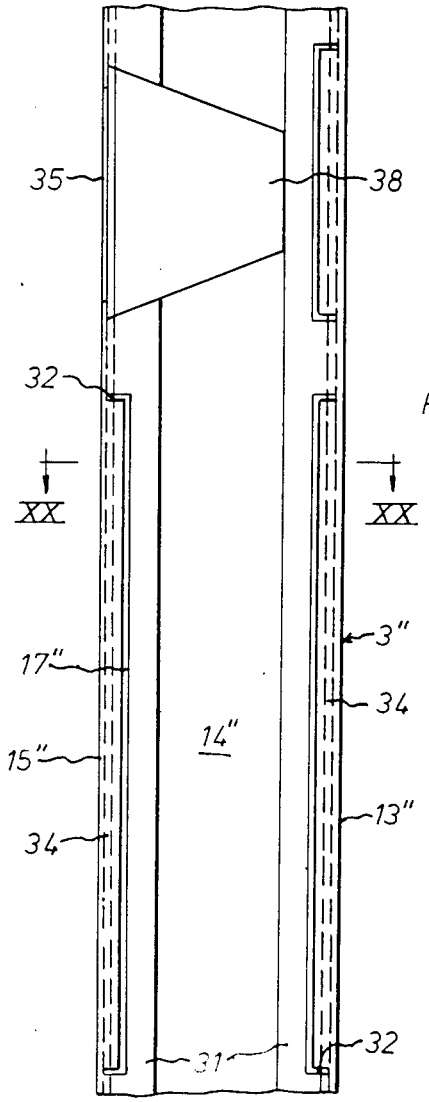
Figure 21:
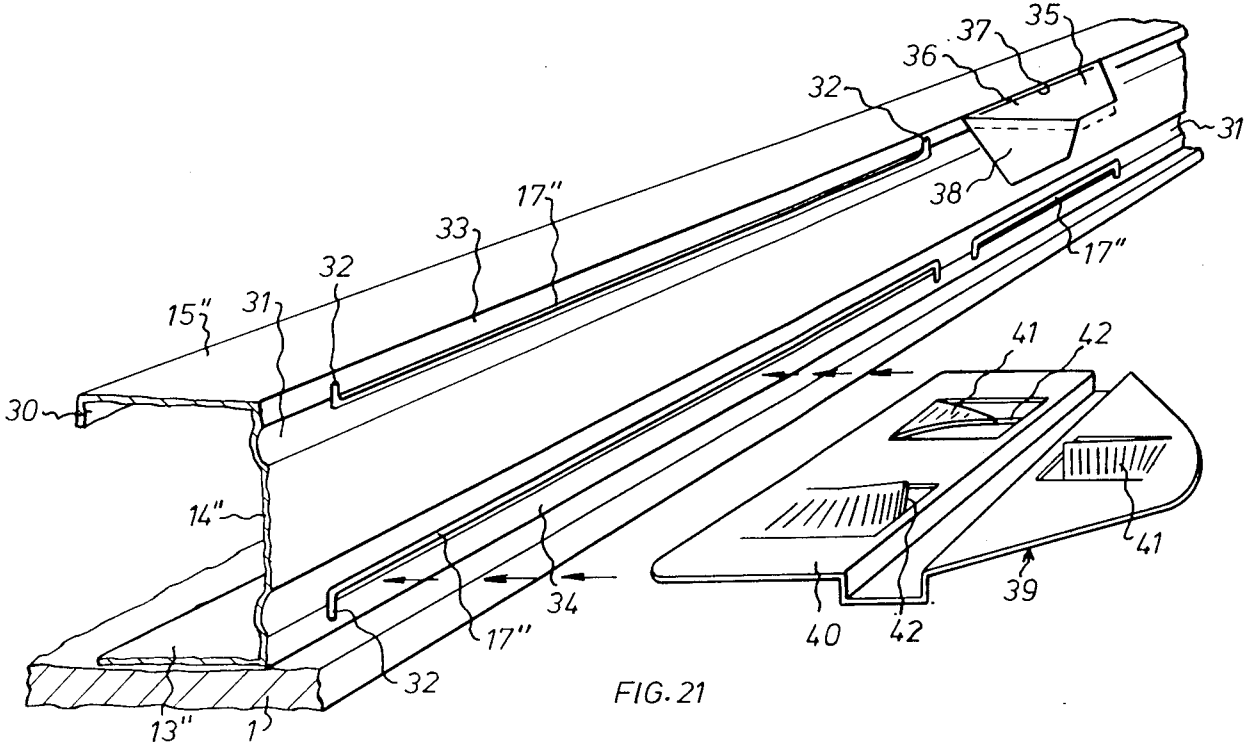

FIGS. 19 20 are respectively a side view and a cross-sectional view on line XX—XX in FIG. 19, showing a preferred of a profile; and FIG. 21 is a perspective view of a portion of a panel with an edge and intermediate profile together with interconnecting means to the adjacent panel.

A panel according to the invention consists of the board 1 proper which may be at least one gypsum board, a chipboard or a fibre board or consist of composite material, concrete, plywood, laminate or the like, and profiles 3 and 4 anchored at least to the two opposite edges but, as shown, preferably also along the central line already when the panel is put in order. Of course the number and the positioning of the profiles may vary. In certain cases transverse profiles 2, indicated by dashed and dotted lines, may also be mounted between the longitudinal profiles 3 and 4 so as to form a lattice work, especially in panels intended for false ceilings and floors. The panel will thus be given very high resistibility to bending and buckling, which permits arranging the attachment points at large intervals. The outer side or layer or, alternatively, in case of multi-layer panels, the outer panel is normally finished on the visible outer side, i.e. painted, wall-papered or provided with some other surface layer. The point is thus that a wall, a ceiling or a floor is to be ready for use once the panels are mounted.

Figure 9:
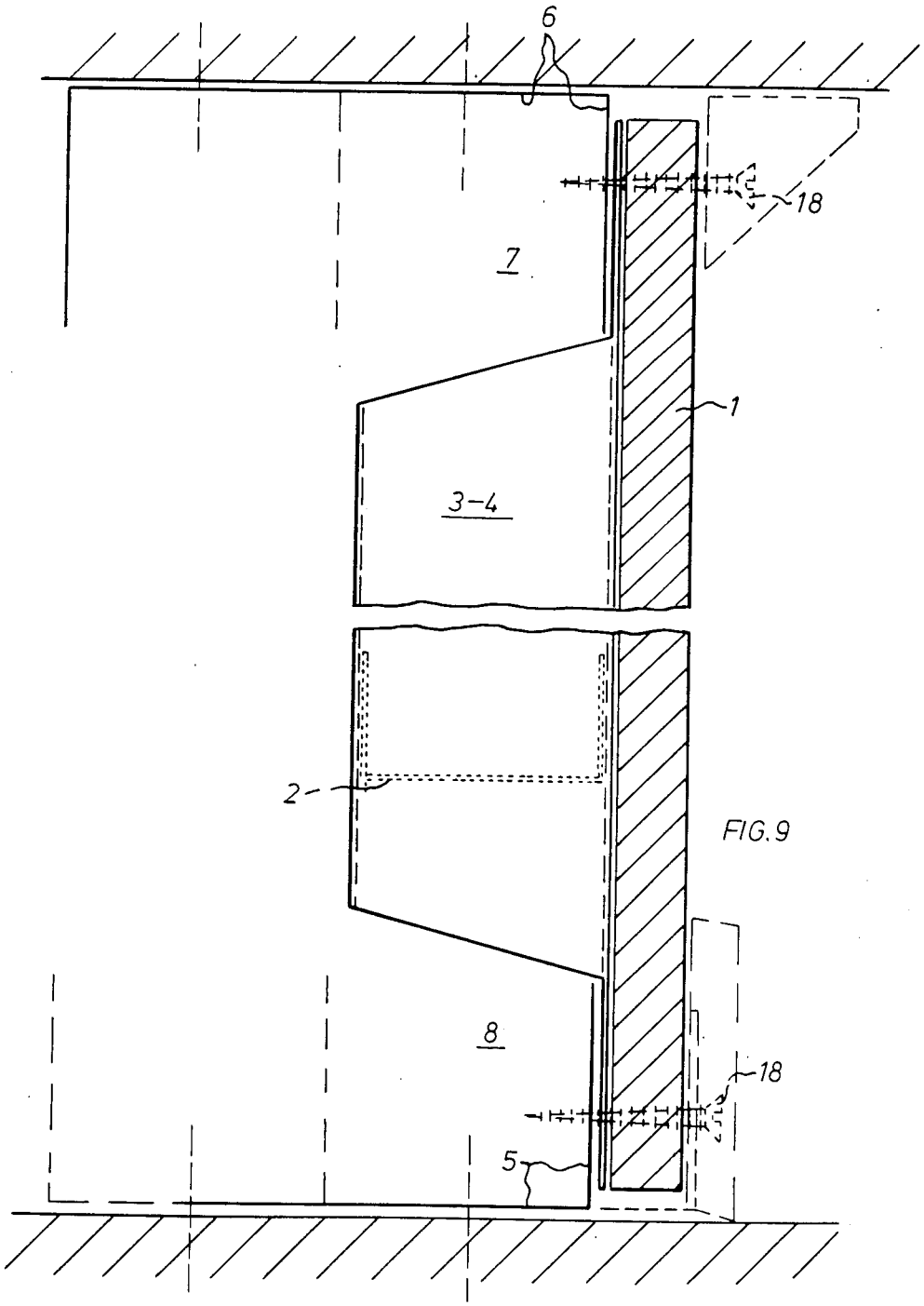
FIG. 9 is a vertical section of a wall including panels according to the invention.

Panels intended for walls are mounted externally on U- or L-bars 5 and 6 secured on the floor and in the ceiling, FIG. 9, and the profiles of the panels adjusted to the height of the ceiling are therefore, preferably already during the manufacture, provided with recesses at 7 and 8 respectively. Fixation of the panels with the integrated framework is only effected on the outside of the floor and ceiling bars 5 and 6 respectively, apart from adjoining building components where conventional connection units are used. Attachment points in the wall field, cover strips over joints and the like are not required.

Using the panel according to the invention will highly simplifly and cheapen the mounting work. Apart from strips, profiles or the like required for adjoining constructions, attachment bars are only needed along the floor and the ceiling, and the shetts in the wall panel are only attached in these bars. This means that the fitter can effect most of the work on the floor. The profiles are bent upwards on the panel placed on the floor or another suitable support and the required insulation is fitted in the spaces between the profiles, whereupon the panel is raised and attached by means of screws to the upper and lower edges of the panel. The upper screws may be replaced by a specific ceiling strip, as will appear below.

From an ergonomical point of view the work will be highly facilitated since the strenuous climbing on trestles or ladders will become reduced to a minimum.

One of the types of profiles used in the panel has a flange 9 attached to the back of the panel, a web 10 and two free flanges 11 and 12 one of which is doubled. The web 10 of the profile may be placed along the centre line of the panel, which facilitates optional cutting of the panel between the outer profiles 3. The flange 12 may be omitted, as will be shown below, and be replaced by spread tongues The other type of profiles, which is used at the panel edges, is U-shaped, has a flange 13 attached to the panel, a web 14 and a simple free flange 15. The profile 3 is as a rule placed so that its web 14 is aligned with the panel edge, with the flange 15 extending inwardly over the back of the panel but the profile may also be placed at a distance from the edge to permit wrapping of e.g. wall-paper around the edge.

Figure 6:
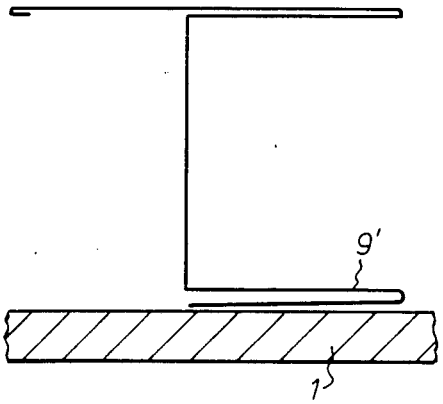
FIGS. 6 and 7 show alternative profile embodiments.

In case great importance is attached to the sound-absorbing and heat-insulating capacity of the panel the profile flanges 9 and 13 facing the panel may instead be bent double, as indicated in FIG. 6, suitably with attenuation of material, perforation or the like at the bend point. The perforated embodiment is in many cases to be preferred since the perforation reduces the material area serving as thermal bridge and sound bridge By allowing that portion of the doubled flange 9' which is closest to the bend, to be bent slightly outwards and to attach the flange leg to the panel only along the zone adjacent the free edge a certain resilience is obtained between the panel and profile, which highly improves the sound-absorbing properties of the panel, since the gap resulting from the double bend permits a certain movement between the panel and profile and the outward bend improves the mobility.

Figure 7:
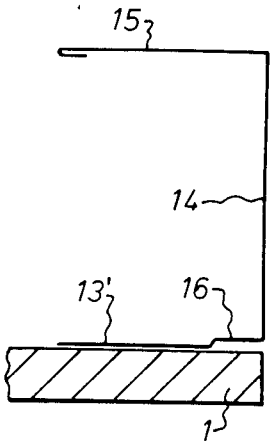

Even if the profiles 3 and 4 per se provide sufficient stability against strains at right angles to the wall it is often desirable to have the panels interconnected in the lateral sense. If the panel material consists of gypsum board the flange 13' attached to the panel, in the profiles 3 arranged along the edges, may have a stamped shoulder as indicated in FIG. 7, said shoulder forming together with the back of the panel a groove or a recess for plastic or sheet metal strips, plates or the like serving as a locking spring. The flange 13' is attached by gluing or the like to the portion of the board beyond the shoulder 16.

Figure 1:
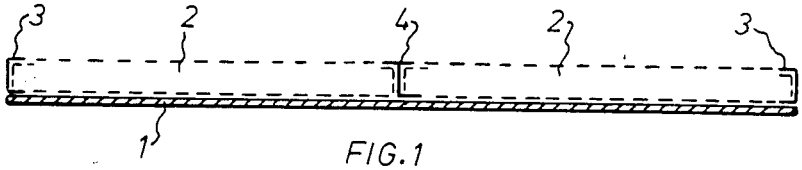
FIG. 1 shows a cross-section of a first embodiment of such a panel.
Figure 2:
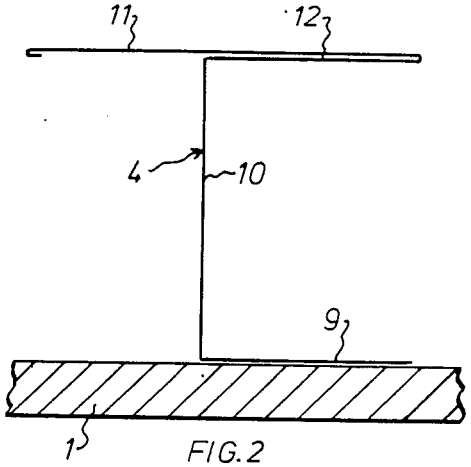
FIGS. 2 and 3 show on a larger scale and in cross-section respectively an intermediate profile and one of the profiles disposed on opposite panel edges in position for use.
Figure 3:
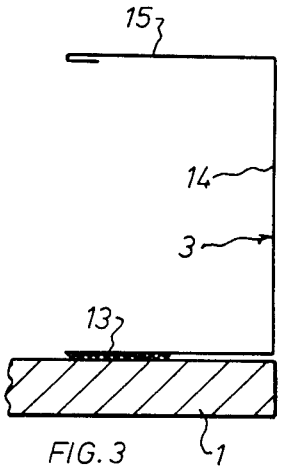

Alternatively, as is apparent from FIG. 3, the flange 13 may be plane but be fastened to the panel only along the zone situated along the free edge. Locking plates or sheet metal strips can thereby be inserted between panel and flange and serve as a locking means between the panels.

Figure 8:
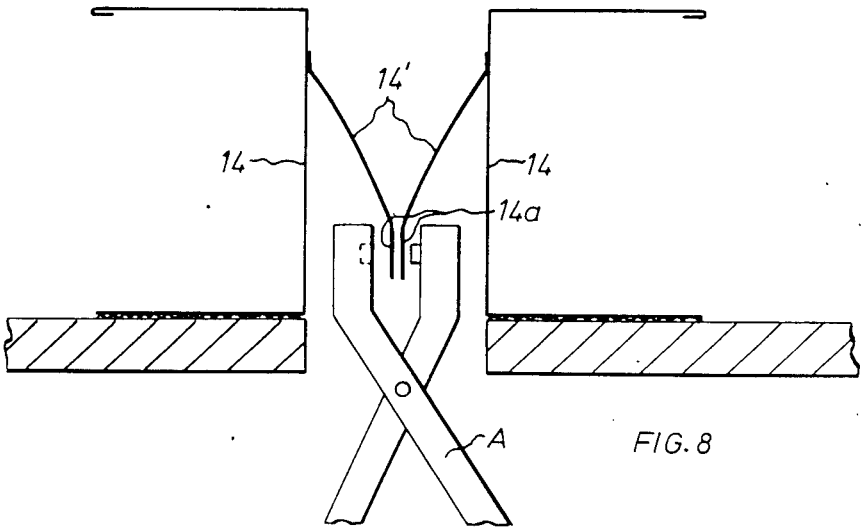
FIG. 8 shows the edge profiles of two panels can be fixed.

FIG. 8 shows an alternative embodiment of interconnecting means. Tongues 14' are punched out or attached in some other suitable manner to the profile webs. The tongues are pre-bent so as to provide abutment sections **14*a* which, after a panel has been raised adjacent another already mounted panel, are fitted relative to each other with the panels spaced apart. The abutment sections 14*a* are punched or riveted together by means of a punch tool A whereupon the panels are brought together. The tongues 14' make the panels retain their relative position. An alternative interconnection means will be described later in conjunction with FIG. 21**.

If the panels consist of plywood or chipboard no specific profile shaping is required since panels of such materials can simply be provided with grooves for receiving a loose tongue or feather or be provided with grooves on one edge and tongues on the other edge.

Figure 4:
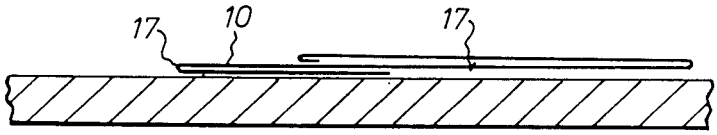
FIGS. 4 and 5 show in the same way said profiles in collapsed condition for transport.
Figure 5:
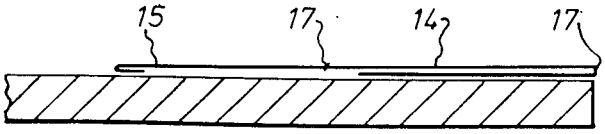

FIGS. 4 and 5 show the profiles folded up or in a collapsed state on the back of the panel. To allow erection or raising in the intended manner the profiles 3 and 4 are, prior to mounting and folding, provided with bending notches 17 in the form of scores, embossed or ground grooves, rows of holes or the like.

In FIG. 9, where the spaces between the details have been strongly exaggerated for greater clarity it is shown how the panel 1 is mounted, in the manner already mentioned, to the outside of U- or L-bars 5 and 6 respectively attached to the floor and the ceiling by means of screws or the like 18. In case the panel 1 consists of a sufficiently resistant material the profiles 3, 4 forming the integrated framework may be allowed to terminate on a level with the edges of the floor or ceiling bars or like supports. In that case only the panel edges projecting beyond the profile ends are utilized for the insertion.

Figure 10:
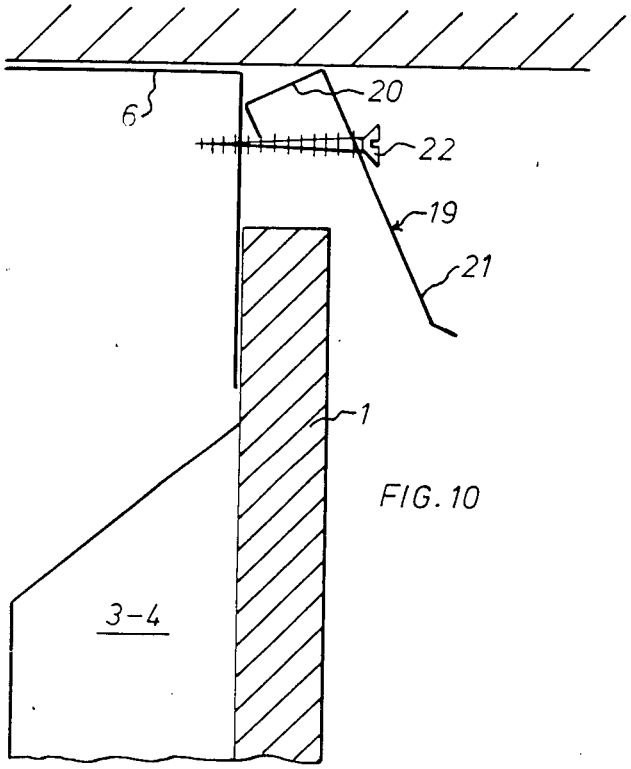
FIGS. 10 and 11 are vertical sections of the top wall portion and show modified details for mounting to the ceiling.
Figure 11:
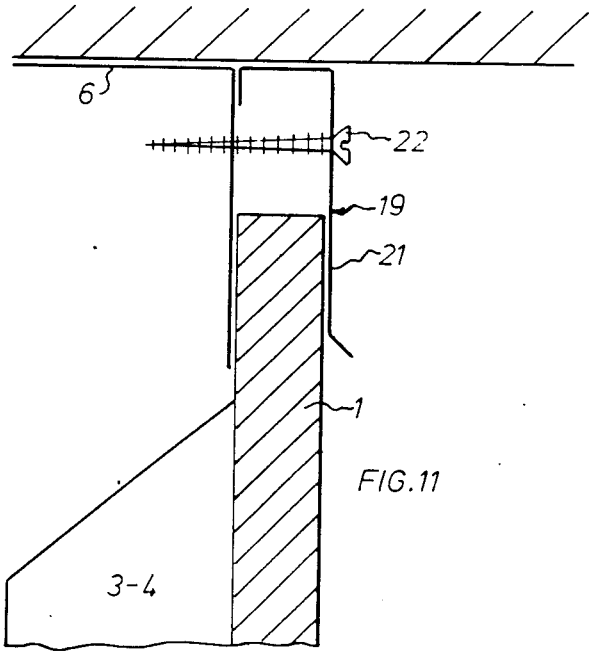

In FIGS. 10 and 11 it is shown how the panel can be fixed and the ceiling strip can be attached in a single.-moment with the aid of a specifically designed ceiling strip 19. The ceiling strip 19 has a U-bent section 20 intended to bear on the ceiling and an extended downwardly projecting flange 21 constituting the visible portion of the ceiling strip.

The ceiling strip is attached by means of a screw 22 which is inserted while the strip is held in an inclined position shown in FIG. 10. On tightening of the screw the ceiling strip will be swung inwards to its intended position in which it will bear against the ceiling and the upper edge of the panel.

An essential advantage with this embodiment is that movements in any overlying part of the building—for instance a swaying system of joists—will not load the panels in the intermediate wall since the downwardly extending flange portion 21 of the strip admits a certain relative vertical movement By using a per se known floor bar with double flanges, the outer of which forms an outside base strip, the mounting can be further simplified. To this effect the lower edge of the panel is pushed down between the two flanges of the floor bar whereupon the panel is pressed backwards at its upper part and is attached in the manner just indicated.

Figure 12:
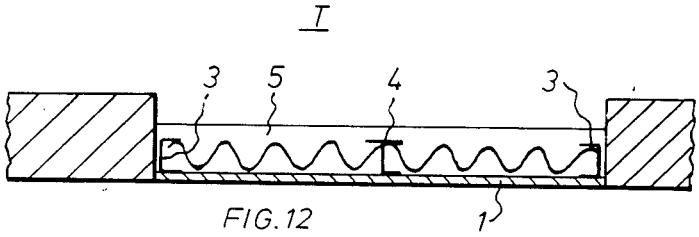
FIG. 12, FIG. 13, FIG. 14 and FIG. 15 illustrate schematically, in the form of horizontal sections, four different ways of using the panel according to the invention.

Panels according to the invention may be used, as appears from FIGS. 12–15, for a great variety of purposes. In FIG. 12 a panel is used as a screening wall against e.g. a drum, a pipe shaft or the like T. Arranged on the back of the panel 1, between the profiles 3 and 4, is an insulation and this may, as required, be covered by a suitable foil material or the like attached to the profiles.

Figure 13:
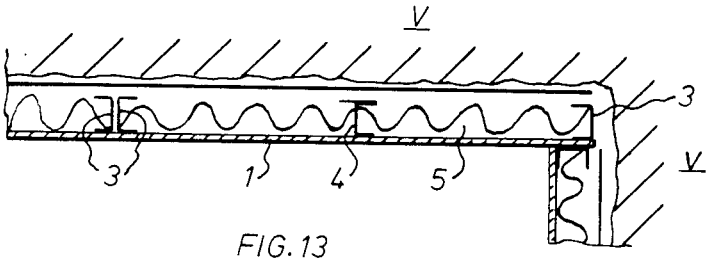

The embodiment according to FIG. 13 is primarily intended to be used for additional insulation or renovation of existing buildings. This requires mounting of U- or L-bars 5 only at the ends of the panel. In laterally adjoining building components conventional supporting or fitting elements are used. No mechanical connection is required between the panels according to the invention and the existing wall, and this implies that plane and vertical walls can be provided in a simple way also in buildings where the existing walls V are inclined due to settings and the like. As there is no mechanical connection between the panels according to the invention and the existing wall there will be no thermal bridges, and a good insulation is obtained for heat as well as against sound transmission. By choosing a suitable panel material a similar embodiment may be utilized for external additional insulation.

The embodiments according to FIGS. 12 and 13 may also illustrate how panels according to the invention are utilized for false ceilings. In case of moderate spans supporting beams are mounted along two parallel walls and the panels are suspended on these beams. In case of large spans or in case other reasons speak against supporting only along the walls, pendulum suspensions are arranged and connected to the panel profiles.

Figure 14:
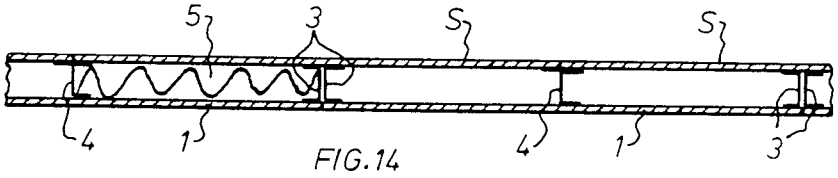

In FIG. 14 it is shown how intermediate walls with moderate demands for sound and heat insulation are built up. A panel material S is attached in a conventional manner on the free flanges 11, 12 and 15 of the profiles 3 and 4 respectively, whereby a thin self-supporting wall is obtained.

Figure 15:
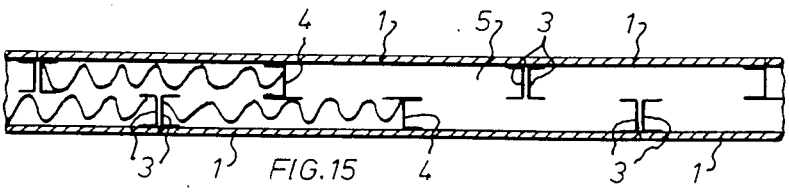

In case an intermediate wall with good sound and heat insulating capacity is desired use is made of the construction according to FIG. 15 which in principle may be said to consist of two walls of panels according to the invention mounted adjacent or at a small distance from each other. As the profiles are placed in zigzag no thermal or sound bridges occur.

Panels according to the invention may, as indicated, also be utilized for false ceilings, to which effect one may utilize a so-called pendulum suspension or allow the ends of the panels to rest against supporting beams arranged on the walls of the room or combinations of the mentioned methods. Panels according to the invention involve that the number of and the distance between the suspension points may be radically reduced.

Provided that the panel material is of a suitable type, e.g. chipboard or plywood, the panels of the invention may be utilized for floors, for instance in fitting up attics where the joist distances are so large that it would be necessary to arrange a specific framework between the joists in order to obtain sufficient stability. Panels of the kind mentioned may also be used as floors in buildings built on a concrete slab on the ground where wooden studs bearing against the concrete slab may give rise to mould damages due to moisture. Panels according to the invention may also be used as floors on e.g. concrete floor structures where an overlying insulation is desired or channels are required for drawing of lines, ventilation and the like.

Framework profiles arranged in the panels in connection with the manufacture may in certain cases be completed or wholly or partially replaced by separate profiles adapted to be connected with the panel by means of quick-coupling fittings attached directly to the panel or the profiles 3 and 4, e.g. profiles having a high bearing capacity for use in large horizontal spans. The complementary profiles are fitted to the panel when this is being prepared for mounting.

Figure 16:
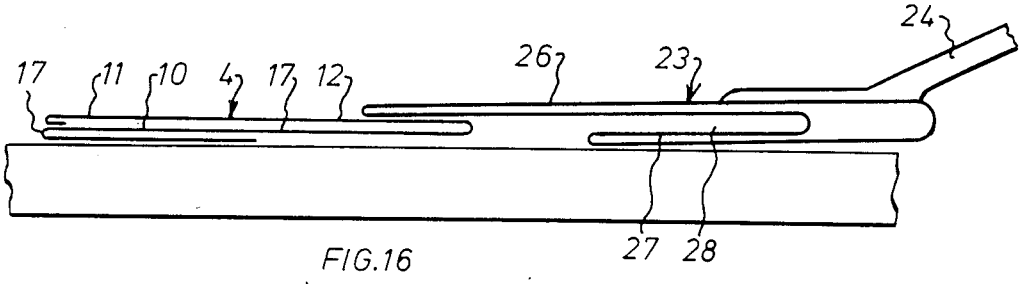
FIG. 16, FIG. 17 and FIG. 18 illustrate how the profiles are raised and a tool adapted for this purpose.
Figure 17:
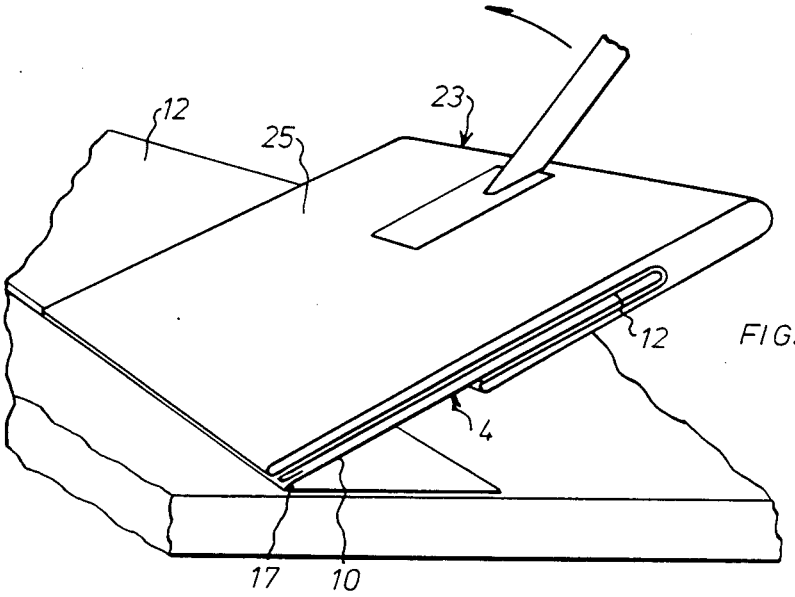
Figure 18:
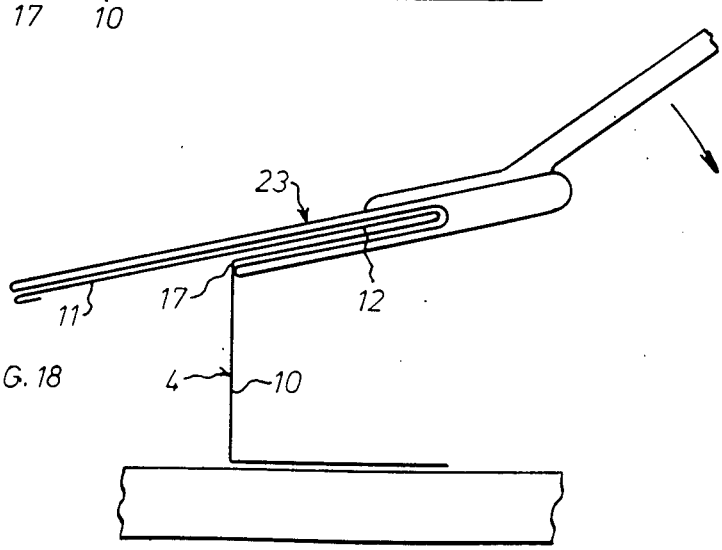

FIGS. 16, 17 and 18 illustrate the course of action in turning up the profiles 3 and 4, and a tool designed for this purpose is schematically shown. FIG. 16 shows a folded intermediate profile 4 with bending notches 17.

The tool 23 consists of a handle 24 and a head 25 of relatively great length. The head, which has little thickness, has an upper leg 26 with a width corresponding to the total width of the flange 12 and the web 16 or the flange 15 and the web 14 and a lower leg 27 having a width corresponding to one of said flanges and these legs define a slot-shaped space 28.

In FIG. 17 it is shown how the tool has been pushed onto the folded profile and is swung upwards whereby the web 10 is erected. When the web has reached an approximately perpendicular position the tool is swung downwards as appears from FIG. 18, where the upper flanges 11, 12 is placed at an angle to the web 10. The procedure is the same when erecting the profiles 3.

Characteristic of the panel according to the invention is that it is to be ready for use. This means that in the normal case no operations in the panel should be necessary on the building site. No fitting, grinding or other types of finishing are necessary after mounting.

Instead of first raising and attaching a framework and applying insulation material therein and then mounting the panel on the framework use is thus made of panels having an invisible framework which is integrated with the panel and in which the required insulation material for heat, fire and sound has been applied before raising. The following modifications of the panel according to the invention are conceivable:

(a) panel with longitudinal or transverse profiles which are attached to the panel and can be raised, (b) panel with profiles which are attached to the panel and can be raised and attachments for complementary studs, (c) panel with attachments which preferably can be raised for structural profiles, (d) panel with profiles which can be raised, with attachments for complementary structural profiles, (e) panel according to (a), (b) or (d) with preferably raisable profiles extending transversely relative to existing profiles.

Mounting of the profiles to the panel material takes place most conveniently in the factory, preferably even on the part of the panel manufacturer. However, on large building sites one may arrange a mounting station where panels and profiles are assembled. To facilitate such mounting the panel material may be provided during the manufacture with fastening means or the like.

In the preferred embodiment shown in FIGS. 19–21 at least one of the flanges 13'', 15'' of the U-shaped profile 3'' is provided with an inwardly flanged stiffening edge 30. The web 14'' has also stiffening longitudinal indentations 31 and may be perforated in order to reduce the energy-conducting area. The heat and sound insulation capacity and the resistibility to fire will thus be increased. To permit folding of the profile this is provided with slits 17'' and since it is desired to maintain the rigidity of the flanges also along those portions where slits are provided said slits are localized to the inner edge of the indentations 17''. The folding axis may lie adjacent the corner edges of the profile and as shown the ends 32 of the slits may therefore be extended toward said edges. It is also possible to effect the folding in alignment with the slits, i.e. in conjunction with the indentation 17''. In both cases the web portions 33, 34 outside the slits 17'' will follow the flanges and constitute stiffening means therefor during folding.

A number of trapeziform tongues 35 are punched out on the profile web 14'' and these are coherent with the profile only along their base portion 36. Along the greater part of the base a through-going slit 37 is provided and this extends along the folding axis, i.e. along the profile edge and the slits respectively.

The tongues 35 may have two purposes In profiles placed at a distance from the edges of the panel the tongues serve as retaining means for the insulation material which is fitted on the panel before this is raised and mounted and said tongues cooperate with an oppositely directed flange in the next profile. The tongues 35 thus fulfil the same purpose as the double bent flange 12 in earlier described embodiments. The tongues 35 may also serve as interconnecting means for complementary structural details 2.

In profiles placed along the board edges the tongues 35 in a board profile cooperate with the tongue recesses 38 of the edge profile of the opposite board in that the tongues are inserted into the recesses. The tongues of the opposite board will bear against the outside of the profile flange of the first profile. This gives a stable interconnection of the boards transversely of the wall plane and along the bearing plane.

In FIG. 8 an interconnecting means has been shown. FIG. 21 shows another such means adjusted for the preferred profile embodiment. The interconnecting means consists of a plate 39 of sheet metal or like material provided with a transverse abutment portion 40 intended to engage with the projecting edge of the respective panel 1 and the web portion 34. On one side of the abutment portion 40 there are two tongues and on the other side one tongue 41 which is cut out so as to be coherent with the plate only at the remote end, as counted from the abutment portion. The tongues 41 are turned so that the inner cross-cut ends 42 make an angle with the plane of the plate.

After a panel has been mounted the portion provided with two tongues is inserted in the slits 17'' via a suitable number of plates 39, said tongues 41 being turned during the insertion so as to lie on a level with the plate in order to snap back when the slit edges have been passed. The cross-cut ends 42 will then engage with the inside of the profile web and lock the plate. When the next panel is mounted the opposite portion of the plates is guided into the profile slits 17'', whereupon the panel is moved towards that already mounted until the single tongue 41 will snap on to the inside of the profile web.

The invention must not be considered restricted to the embodiments described above and illustrated in the drawings but may be modified in various ways within the scope of the appended claims.

What I claim and desire to secure by Letters Patent is:

1. In a wall structure of a building, a surface-forming panel comprising a planar rectangular facing element of building material, a collapsible sheet metal reinforcing framework on a rear surface of the element, the element having a first pair of opposite edges and a second pair of opposite edges perpendicular to the first pair of edges, and attachment means between the panel and the wall structure independent of the reinforcing framework comprising plural foldable profiled elements each having a flange portion secured to the rear surface of the facing element and a body portion with bend lines for unfolding the element from a transport position, the framework including a pair of of the profiled elements positioned in parallel along the first pair of opposite edges of the facing element, the wall structure including parallel panel supports substantially aligned with the second pair of opposite edges, the attachment means consisting entirely of fasteners connected between the panel and said supports, the profiled elements extending lengthwise between the supports in substantially continuous engagement with a rear surface of the panel thereby providing reinforcement for the panel between said supports and the profiled elements being adapted for folding in a direction perpendicular to their length.

2. The invention of claim 1, wherein the profiled elements are channel-shaped with a base wall of the respective channel-shaped element aligned with the respective edge of the panel, the webs of the channel facing toward the center of the panel, with an inner one of said webs constituting the flange portion secured to the rear surface of the facing element.

3. The invention of claim 2, wherein an outer edge portion of each inner web is raised away from the rear surface of the facing element to receive attachment means for securing the panel to an adjacent panel.

4. The invention of claim 1, wherein the flange portion of at least one of the profiled elements is folded about a fold line defining a pair of leg portions with a space therebetween, one of said leg portions being attached to the rear surface of the facing element.

5. The invention of claim 4, wherein said one of the leg portions is attached to the facing element at a location remote from the fold line.

6. The invention of claim 2, wherein the web of one of the channel-shaped profiled elements is attached to a like web of a profiled element of a further adjacent panel by tongues extending from the respective webs secured together by fastening means.

7. The invention of claim 2, wherein the web of one of the channel-shaped profiled elements is formed with longitudinal stiffening ridges and an elongate slot for receiving a plate with a resilient connector tongue for connecting the element to a like element of an adjacent panel.

8. The invention of claim 7, wherein adjacent the slot, the web is provided with an upset member forming a plate for insertion in a corresponding slot of the like element of an adjacent panel.

9. The invention of claim 1 wherein said pair of profiled elements each extend substantially to each of said second pair of opposite edges of the facing element.

10. The invention of claim 9 wherein opposite end portions of the profiled elements are flattened for attachment to the respective supports.

11. The invention of claim 1 wherein the framework includes a further parallel profiled element between said pair of elements.

12. The invention of claim 1 wherein the framework includes at least one further profiled element extending transversely between said pair of elements.

* * * * *